US005730275A

United States Patent [19]

Hansen

[11] Patent Number: 5,730,275

[45] Date of Patent: Mar. 24, 1998

[54] CUP CONVEYOR

[75] Inventor: Stephen G. Hansen, St. Louis Park, Minn.

[73] Assignee: Thiele Engineering Company, Edina, Minn.

[21] Appl. No.: 607,210

[22] Filed: Feb. 26, 1996

[51] Int. Cl.[6] ..... B65G 47/30

[52] U.S. Cl. ..... 198/460.3; 198/462.2; 198/607; 414/798.9; 414/786

[58] Field of Search ..... 414/797.7, 798, 414/798.1, 798.9, 786; 198/607, 690.2, 817, 460.3, 462.2

[56] References Cited

U.S. PATENT DOCUMENTS

| | | | |
|---|---|---|---|
| 683,039 | 9/1901 | Hagen | 198/607 |
| 1,135,146 | 4/1915 | Strickland | 198/607 |
| 1,744,363 | 1/1930 | Chapman | 198/607 |
| 2,234,465 | 3/1941 | Carroll | 198/607 |
| 3,880,420 | 4/1975 | Martin | 198/462.2 |
| 4,132,012 | 1/1979 | Saloom | 198/817 |
| 4,194,442 | 3/1980 | Martelli | 414/797.7 |
| 4,225,034 | 9/1980 | Sarovich | 198/607 |
| 5,061,231 | 10/1991 | Dietrich et al. | 414/797.7 |
| 5,114,307 | 5/1992 | Meli et al. | 271/309 |
| 5,161,792 | 11/1992 | Wood | 198/462.2 |
| 5,186,600 | 2/1993 | Wokeck et al. | 198/607 |
| 5,383,761 | 1/1995 | Fluck | 414/797.7 |

FOREIGN PATENT DOCUMENTS

| | | | |
|---|---|---|---|
| 2216508 | 10/1989 | United Kingdom | 414/797.7 |

*Primary Examiner*—David A. Bucci
*Assistant Examiner*—Douglas A. Hess
*Attorney, Agent, or Firm*—Hugh D. Jaeger

[57] ABSTRACT

An inclined hopper system for the conveyance of irregular shaped geometric blank material upwardly along an inclined specially configured conveyor for presentation to a specially configured gravity hopper having a plurality of adjustment mechanisms for accommodation of irregularly geometrically shaped blanks such as paper cup sidewall members.

9 Claims, 9 Drawing Sheets

CUP CONVEYOR

BACKGROUND OF THE INVENTION

1. Field of the Invention

The present invention is for an inclined hopper system and, more particularly, pertains to an inclined hopper system for the vertical conveyance of awkwardly or irregularly shaped geometric blank members such as paper cup sidewall members or the like.

2. Description of the Prior Art

Prior art cartoning systems often featured input conveyors and hoppers elevated at a distance somewhat above the components of the system such as a pick and place mechanism as well as other conveyors and processing areas. Loading of the input conveyors at a high level above the floor presented loading problems. Usually the conveyor was above shoulder height and loading was difficult as the surface upon which the cartons were to be set were above the sight level of the human eye and placement of cartons was not always as accurate as desired. Often loading of a high conveyor involved use of a ladder or other height enhancing device which placed the loading person in a precarious position with a load of blanks in their hands.

The present invention overcomes the disadvantages of the prior art by providing a conveyor system for use having a low mounted input conveyor system. The conveyor moves irregular shaped blanks from the level of a low mounted conveyor system and upwardly along an inclined plane to deliver unerected blanks to a hopper associated with a pick and place mechanism.

SUMMARY OF THE INVENTION

The general purpose of the present invention is an inclined hopper system.

According to one embodiment of the present invention, there is provided an inclined hopper system having a lower horizontal input conveyor intersecting an inclined conveyor. The inclined conveyor transports irregularly shaped planar items along an angled path by a centrally located toothed belt which is flanked by vertical guide channels. The inclined conveyor interfaces with a gravity hopper having adjustable guides and mechanisms which guide the incoming irregularly shaped planar members for presentation to a rotary placement mechanism attached to an upper horizontal output conveyor.

One significant aspect and feature of the present invention is an inclined hopper having a single ascending belt aligned central to the inclined belt structure.

Another significant aspect and feature of the present invention is a central inclined hopper belt having teeth.

Still another significant aspect and feature of the present invention is vertical channel guides flanking the toothed hopper belt.

Yet another significant aspect and feature of the present invention is an inclined conveyor and a gravity hopper joined together at their upper regions about a common shaft.

An additional significant aspect and feature of the present invention is control knob actuated vertical adjustment of a top magazine shaft and upper top bar guides.

A further significant aspect and feature of the present invention is a plurality of horizontally adjustable horizontally aligned side bar guide assemblies.

A still further significant aspect and feature of the present invention is control knob actuated lateral adjustment of guide assemblies and the knob actuated vertical adjustment of guide assemblies.

Having thus described embodiments of the present invention, it is one object of the present invention to provide an inclined hopper system for conveying of irregular shaped blank material along the members of an inclined hopper system for presentation to a configured gravity hopper.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DETAILED DESCRIPTION OF THE PREFERRED EMBODIMENTS

Figure 1:
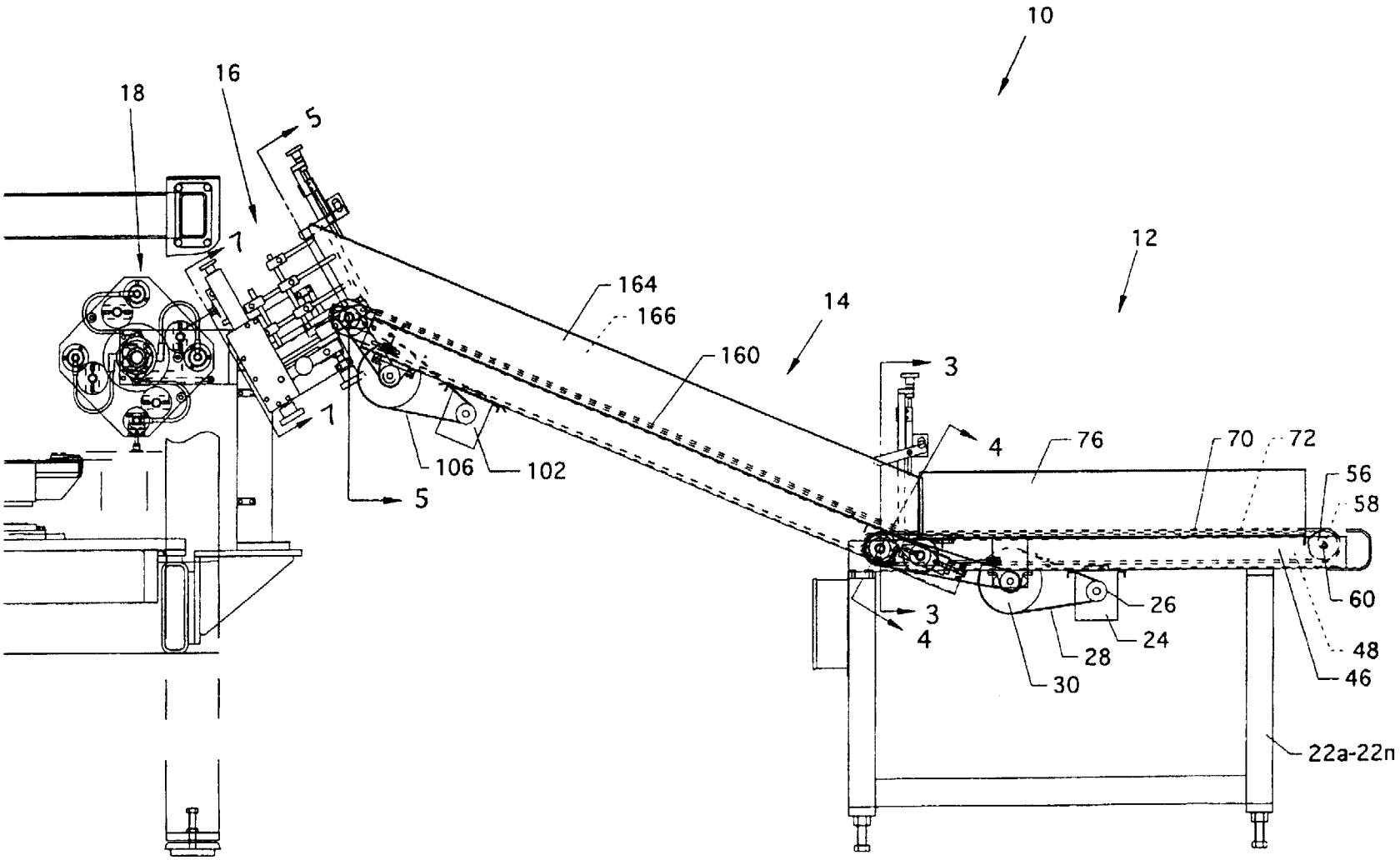
FIG. 1 illustrates a side view of an inclined hopper, the present invention.

FIG. 1 illustrates a side view of an inclined hopper system 10, the present invention, including a lower horizontal input conveyor 12, an inclined conveyor 14, a gravity hopper 16 and a rotary placement mechanism 18. The inclined hopper system is designed for conveying of non-rectangular shape paper cardboard or like planar materials, such as a truncated-like triangular drinking cup sidewall member. The lower horizontal input conveyor 12 is at a convenient height for loading, such as waist level, and intersects the lower region of the inclined conveyor 14 to effect transfer of collapsed paper cup sidewall members from the lower horizontal input conveyor 12 to a position where the paper cup sidewall member is transferred from wide spaced support belts on the lower horizontal input conveyor to the inclined conveyor 14 having a centrally located support belt as illustrated later in detail. The paper cup sidewall members are conveyed via the inclined conveyor 14 to gravity hopper 16 which includes a plurality of adjustable members for effective setup and handling of the somewhat irregular shaped paper cup sidewall members. The rotary placement mechanism 18 picks and places the paper cup sidewall members on an upper horizontal output conveyor as desired.

Figure 2:
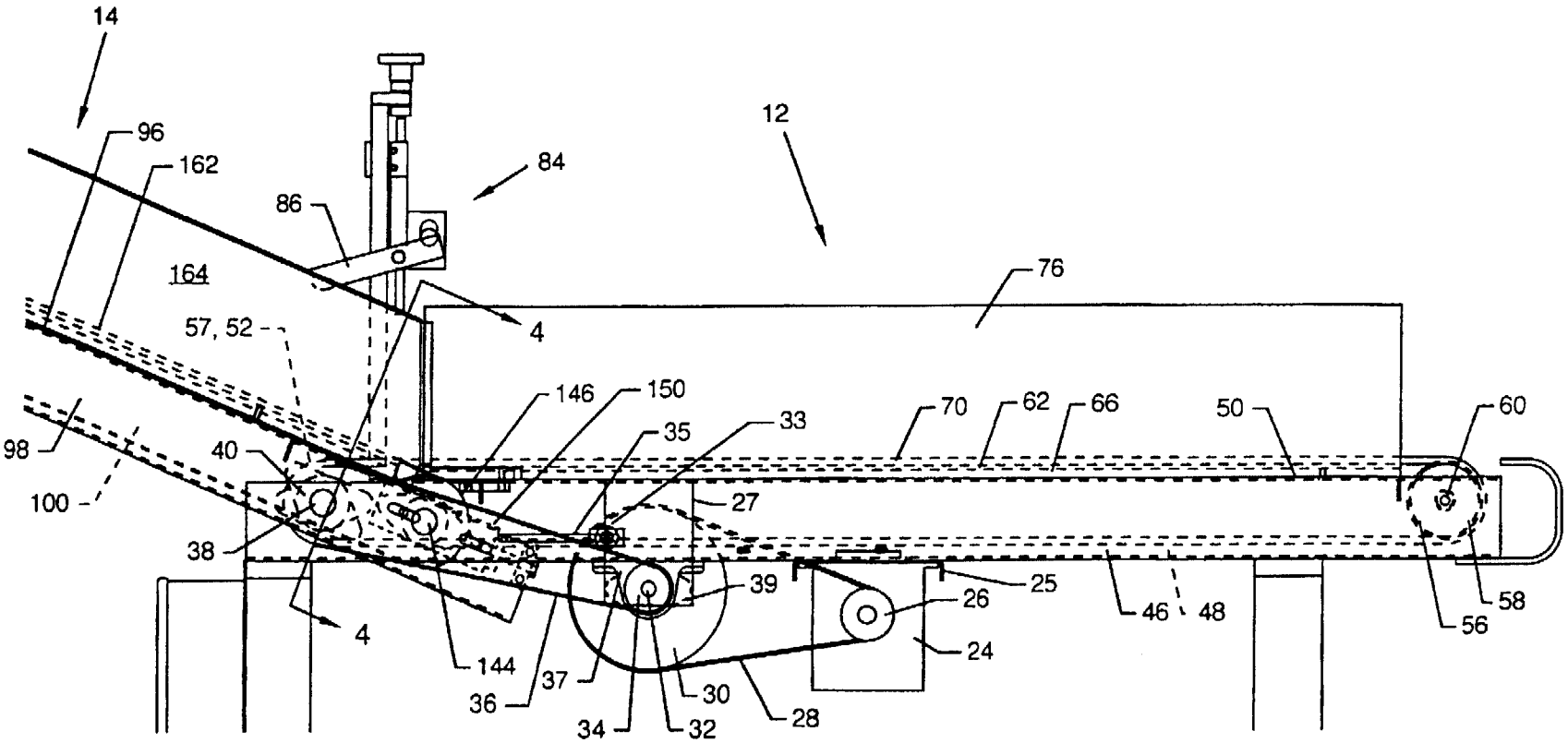
FIG. 2 illustrates the intersection of the horizontal input conveyor with the inclined conveyor.
Figure 3:
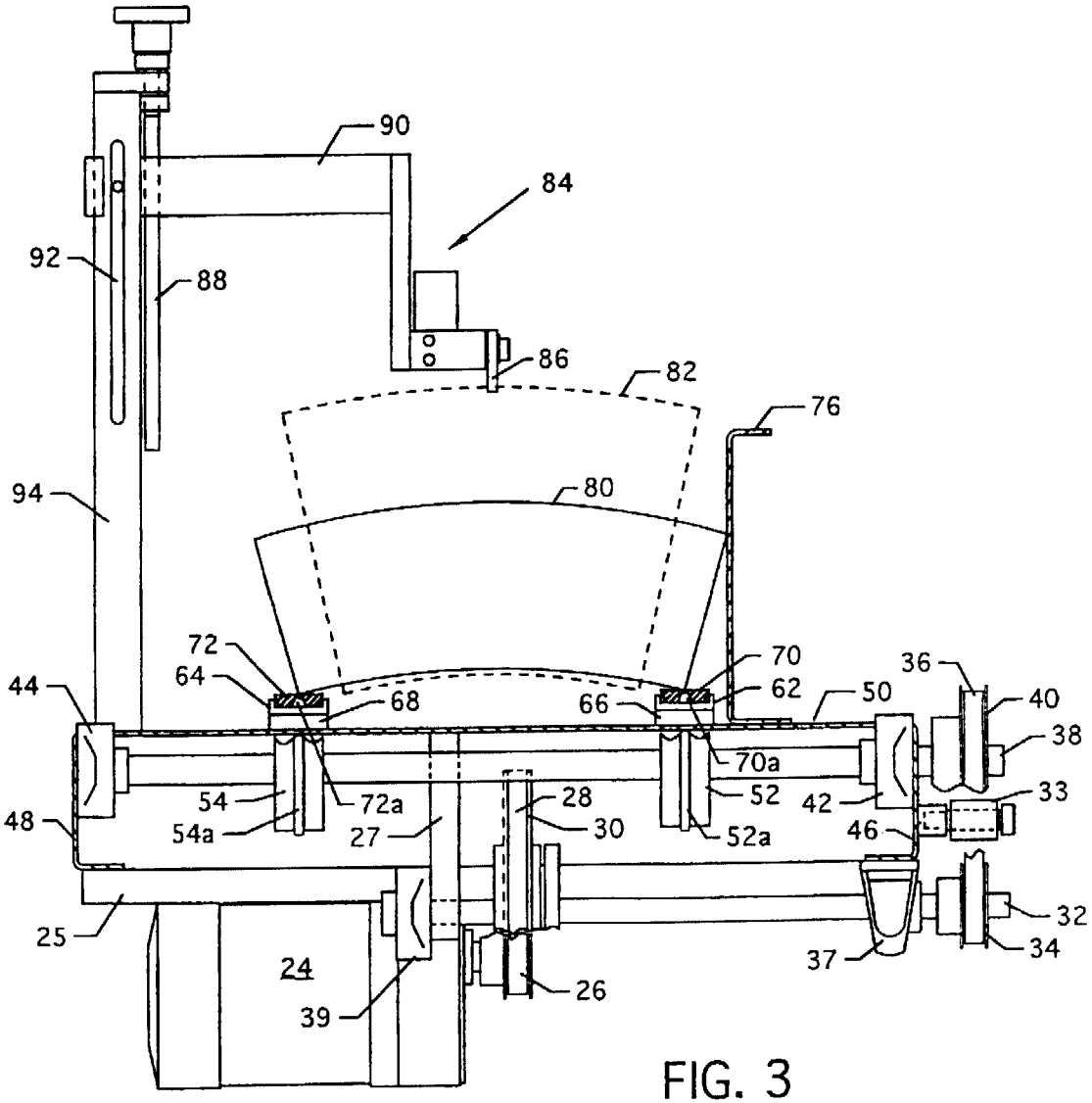
FIG. 3 illustrates a cross sectional view of the horizontal input conveyor along line 3—3 of FIG. 1.

A mechanical description of the present invention regarding the lower horizontal input conveyor 12 now follows with reference to FIGS. 1, 2 and 3 where all numerals correspond to those elements previously described. The lower horizontal input conveyor 12 includes a framework having members 22*a*–22*n* upon which a plurality of members are supported.

A motor 24, pulley 26, and belt 28 power a larger pulley 30 on shaft 32 secured to the framework by bearing assemblies 37 and 39 respectively.

A pulley 34 on shaft 32 and a belt 36 drive a conveyor drive shaft 38 via a drive pulley 40 secured over and about conveyor shaft 38. An idler pulley 33 in an adjustable slot 35 rides against belt 36. Conveyor drive shaft 38 secures in bearing assemblies 42 and 44 attached to side members 46 and 48 of the conveyor deck 50 which assumes the shape of a wide channel. Belt pulleys 52 and 54, having a central annular ridge **52*a* and 54*a* respectively, secure over and about the conveyor drive shaft 38**.

End belt pulleys 56 and 58, similar to belt pulleys 52 and 54, align over and about a shaft 60 appropriately secured to one end of the conveyor deck 50 as previously described. Belt channels 62 and 64, and belt channel spacers 66 and 68, secure to the upper planar area of the conveyor deck 50 in alignment with belt pulley sets 52–56 and 54–58 respectively. Belts 70 and 72 align in belt channels 62 and 64 between belt pulley sets 52–56 and 54–58 respectively. The belts 70 and 72, illustrated in FIG. 3, include grooves **70*a* and 72*a* on the inner belt circumference which correspondingly engage annular ridges 52*a* and 54*a* on belt pulleys 52 and 54 and the corresponding annular ridges of belt pulleys 56 and 58. A vertical guide panel 76 mounts in close proximity to belt 70. A paper cup sidewall member 80 and an alternately sized paper cup sidewall member 82 are illustrated on belts 70 and 72. An adjustable stack sensing switch 84, including an actuating lever 86, mounts to an adjustable screw member 88 which vertically adjusts the stack sense switch 84 via a horizontal arm 90 and associated support members. Arm 90 adjustably aligns and rides in slot 92 in the vertical mount 94 to raise or lower the stack sensing switch 84** with respect to the paper cup sidewall member stack.

Inclined conveyor 14 intersects the lower horizontal input conveyor 12 as illustrated in FIG. 2, as well as in FIG. 4, as described later in detail.

FIG. 2 illustrates the intersection of the horizontal input conveyor 12 with the inclined conveyor 14 where all numerals correspond to those elements previously described. Activating lever 86 causes stack sensing switch 84 to result in activation of conveyor 12 to supply sufficient material to inclined conveyor 14.

FIG. 3 illustrates a cross sectional view of the horizontal input conveyor 12 along line 3—3 of FIG. 1 where all numerals correspond to those elements previously described. Activating lever 86 is shown in contact with a paper cup sidewall 80. If the supply of paper cup sidewall is insufficient, stack sensing switch 84 located at the bottom of the inclined conveyor 14 is activated.

Figure 5:
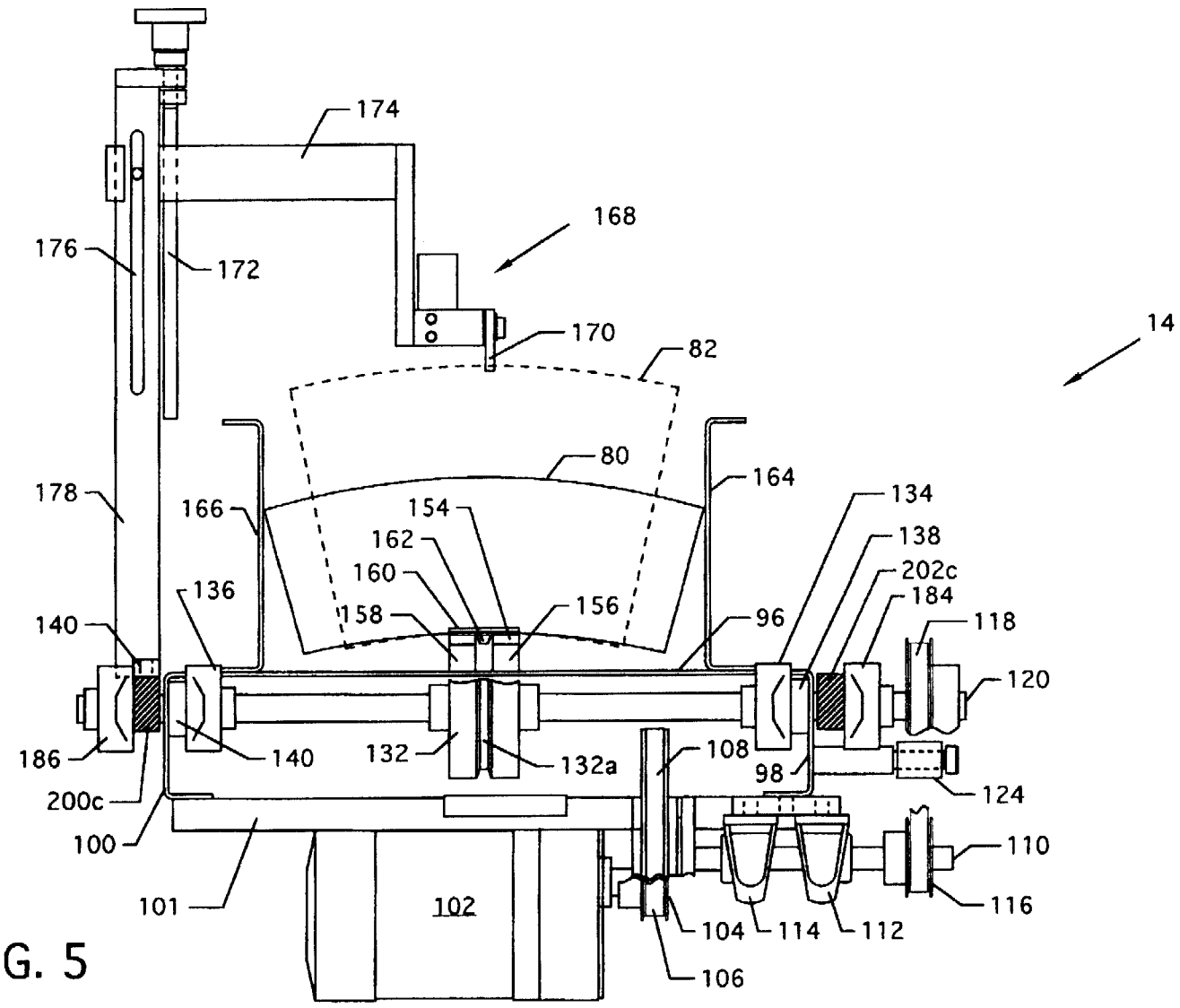
FIG. 5 illustrates a cross sectional view of the upper region of the inclined conveyor along line 5—5 of FIG. 1.

FIG. 5 illustrates a cross sectional view of the upper region inclined conveyor 14 along line 5—5 of FIG. 1 where all numerals correspond to those elements previously described. Components of FIG. 5 are described later in detail. Activating lever 170 located at the top of the inclined conveyor 14 is shown in contact with a paper cup sidewall. If an insufficient supply of paper cup sidewall is given to the inclined hopper, the stack sensing switch 168 at the top of the inclined conveyor 14 is activated.

Figure 6:
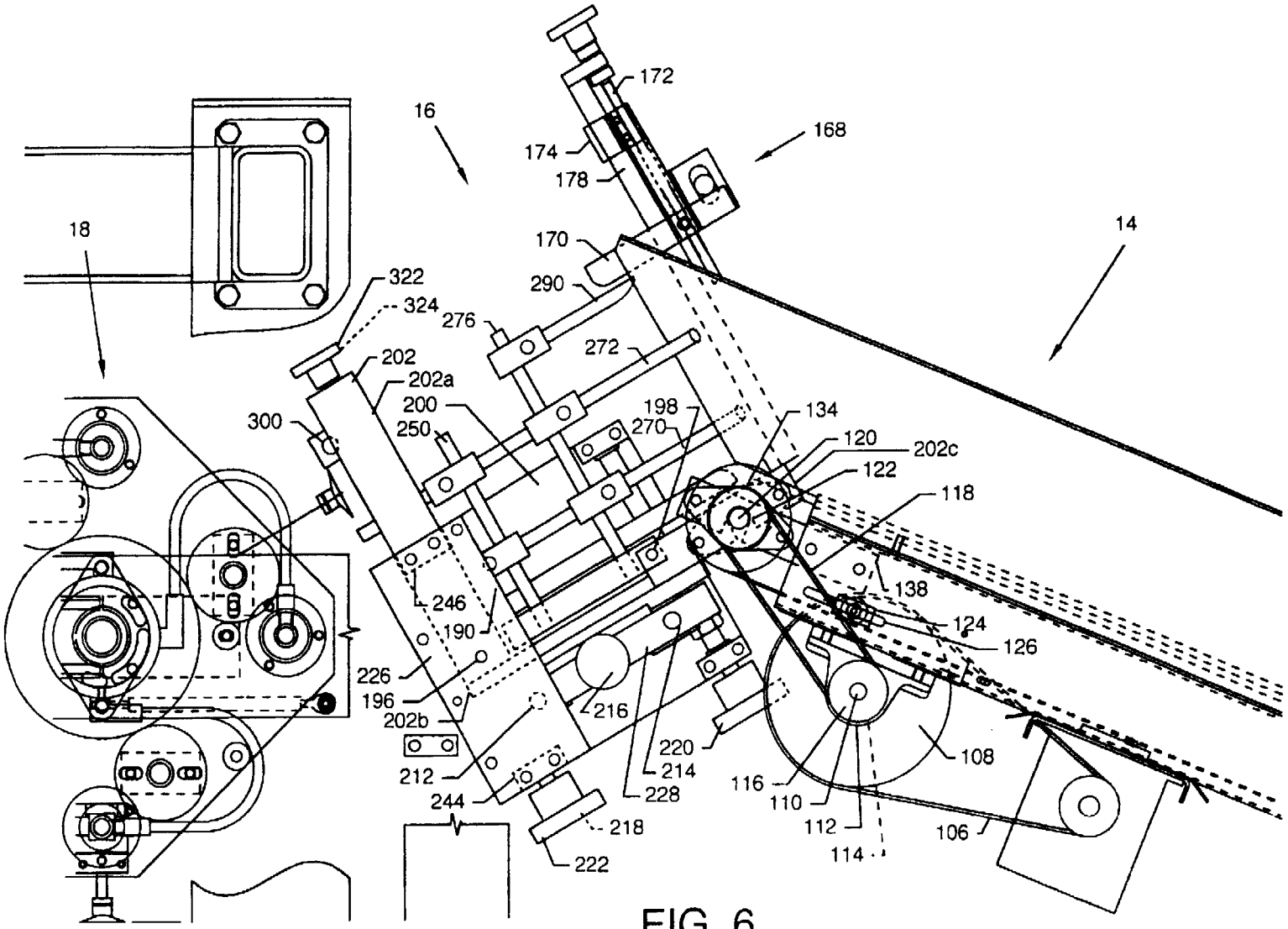
FIG. 6 illustrates a side view of the upper region of the inclined conveyor and the gravity hopper.

FIG. 6 illustrates a side view of the upper region of the inclined conveyor 14 and the gravity hopper 16 where all numerals correspond to those elements previously described. Activating lever 170 causes stack sensing switch 168 to activate conveyor 14 if insufficient supply of conveyed material is supplied to gravity hopper 16.

A mechanical description of the invention regarding the inclined conveyor 14 now follows with reference to FIGS. 2, 4, 5 and 6. Inclined hopper 14 includes component members aligned and secured to a conveyor deck 96 having perpendicular vertical side members 98 and 100, as well as to other members being framework members or otherwise. The upper region of the inclined conveyor 14, including a transverse motor mount channel 101, a motor 102, pulley 104, and belt 106, power a larger pulley 108 on shaft 110 secured to the framework by bearing assemblies 112 and 114 respectively.

A pulley 116 on shaft 110 and a belt 118 power a conveyor drive shaft 120 via a drive pulley 122 secured over and about conveyor shaft 120. An idler pulley 124 in an adjustable slot 126 rides against belt 118. Conveyor drive shaft 120 secures in bearing assemblies 134 and 136 via mounting bars 138 and 140 secured to side members 98 and 100 respectively. Shaft 120 secures in bearing assemblies 128 and 130 attached to side members 98 and 100 of the conveyor deck 96 which assumes the shape of a wide channel. Centrally located belt pulley 132, having a central annular groove **132*a*, secures over and about the conveyor drive shaft 120**.

Figure 4:
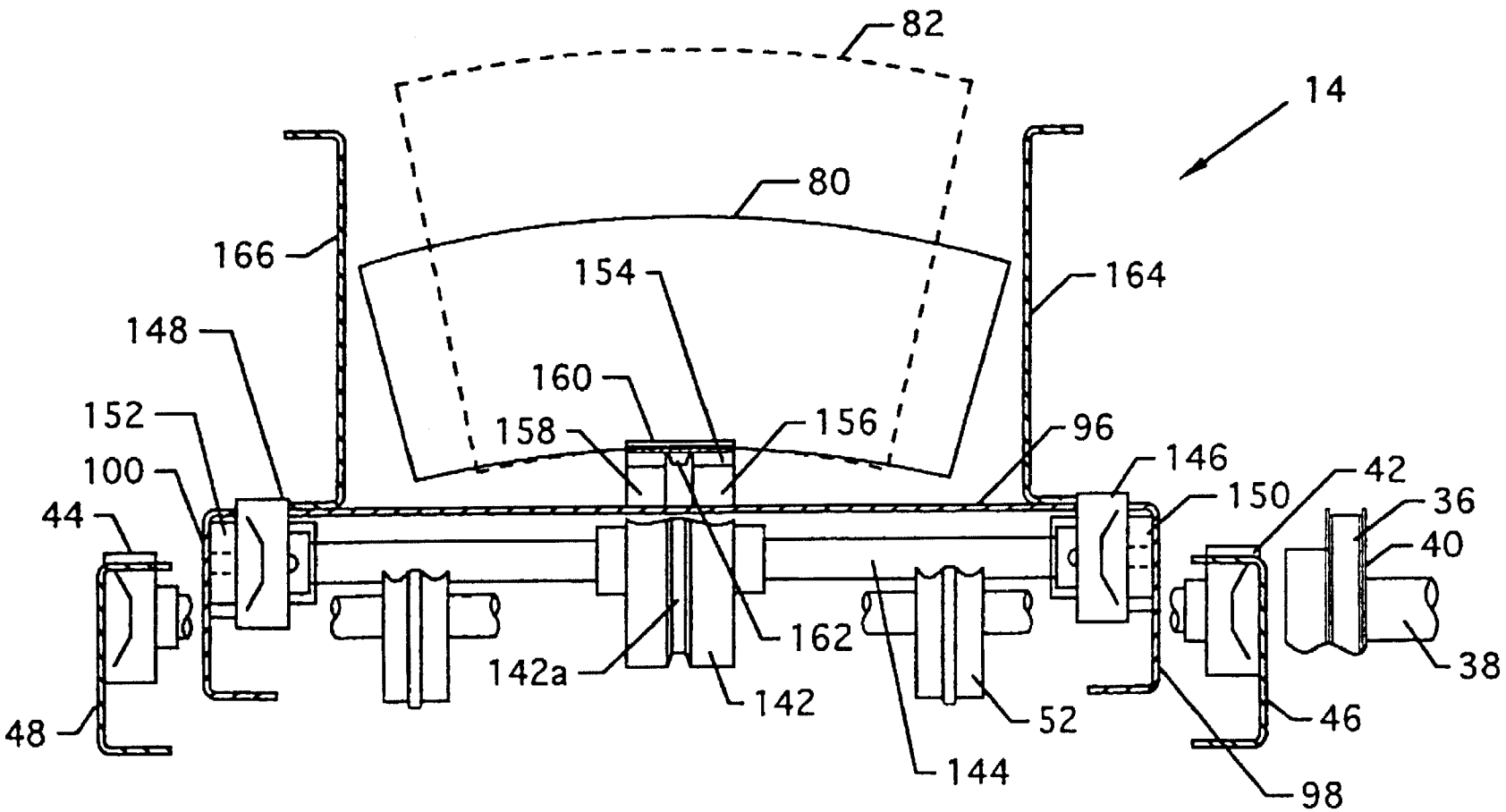
FIG. 4 illustrates a cross sectional view of the lower region of the inclined conveyor along line 4—4 of FIG. 1.
Figure 9:
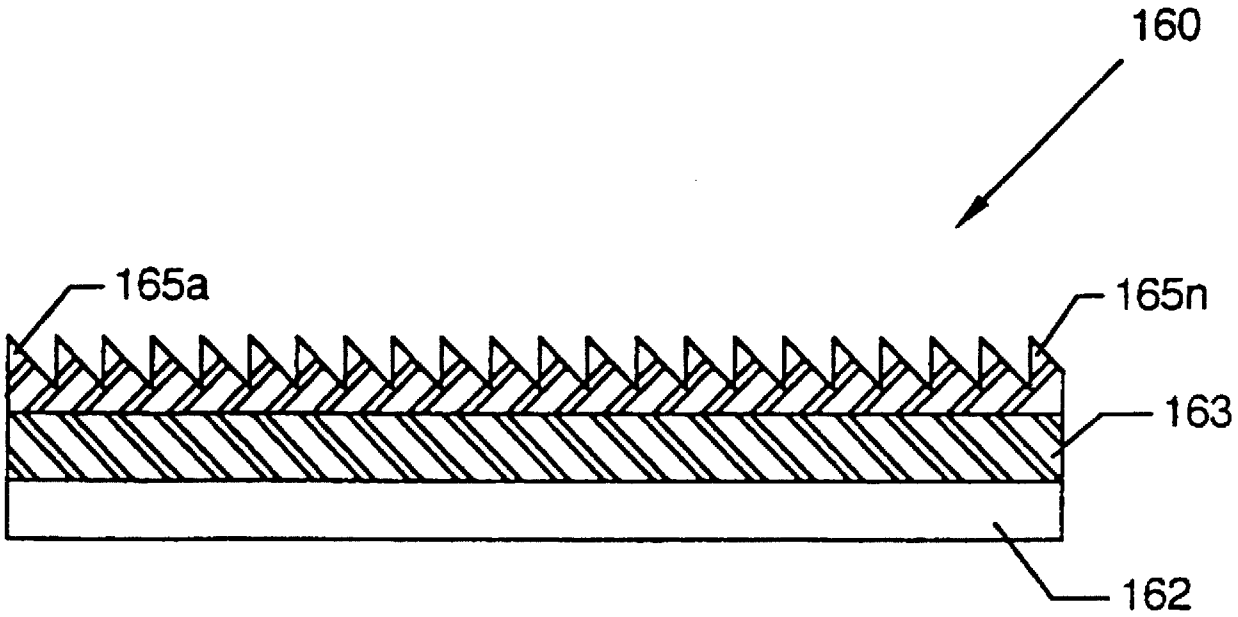
FIG. 9 illustrates a cross sectional view of a toothed belt.

As illustrated in FIGS. 2 and 4, an end belt pulley 142, similar to belt pulley 132, aligns over and about a conveyor shaft 144 secured to the lower end of the inclined conveyor 14. Conveyor shaft 144 secures in bearing assemblies 146 and 148 via adjustable mounting bars 150 and 152 secured to side members 98 and 100 respectively. Belt channels 154 and belt channel spacers 156 and 158 secure to the upper planar area of the inclined conveyor deck 96 in alignment with belt pulley set 132–142. A belt 160, as also illustrated in FIG. 9, includes an annular tracking ridge 162 on the inner belt circumference which correspondingly engages grooves **132*a* and 142*a* of belt pulleys 132 and 142. Vertical guide panels 164 and 166 mount parallel to belt 160. A paper cup sidewall member 80 and an alternately sized paper cup sidewall member 82 are illustrated on belt 160. An adjustable stack sensing switch 168, including an actuating lever 170, mounts to an adjustable screw member 172 which vertically adjusts the stack sense switch 168 via a horizontal arm 174 and associated support members. Arm 174 adjustably aligns and rides in slot 176 in the vertical mount 178 to raise or lower the stack sensing switch 168** with respect to the paper cup sidewall member stack.

Gravity hopper 16 aligns to the upper end of the inclined conveyor 14 which aligns to the horizontal at approximately 22½°, although any other appropriate angle can be utilized. Conveyor shaft 120 serves as a mount for the gravity hopper 16. The gravity hopper 16 aligns to 30° with respect to the horizontal. Opposing horizontal portions **202*c* and 200*c* of L-brackets 202 and 200, respectively, serve as mounts for attached bearing assemblies 184 and 186 which align over and about the conveyor shaft 120 to effect a mount about the conveyor shaft 120 which is common to the inclined conveyor 14 and the gravity hopper 16**.

Figure 7:
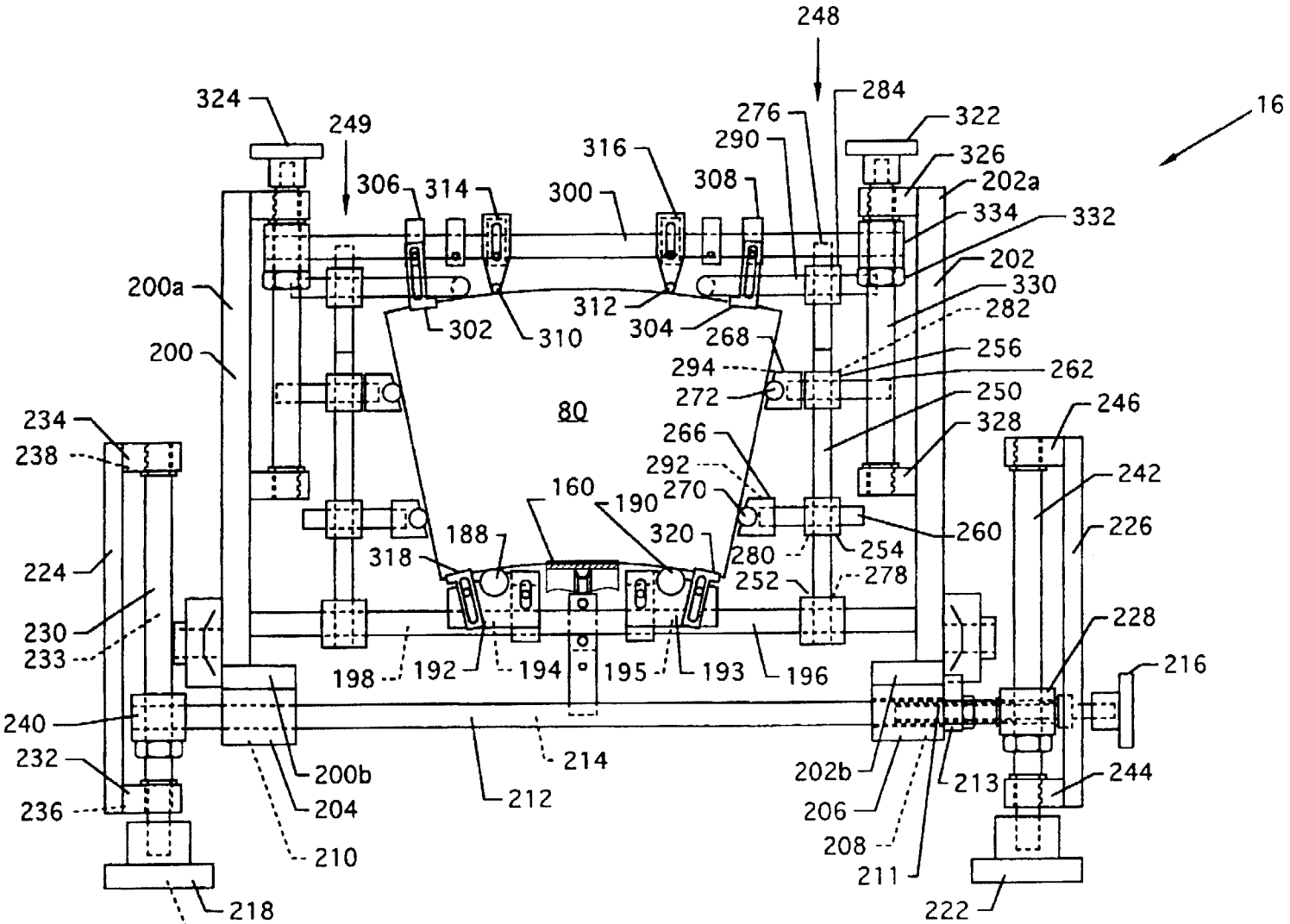
FIG. 7 illustrates an end view of the gravity hopper 16 along line 7—7 of FIG. 1.
Figure 8:
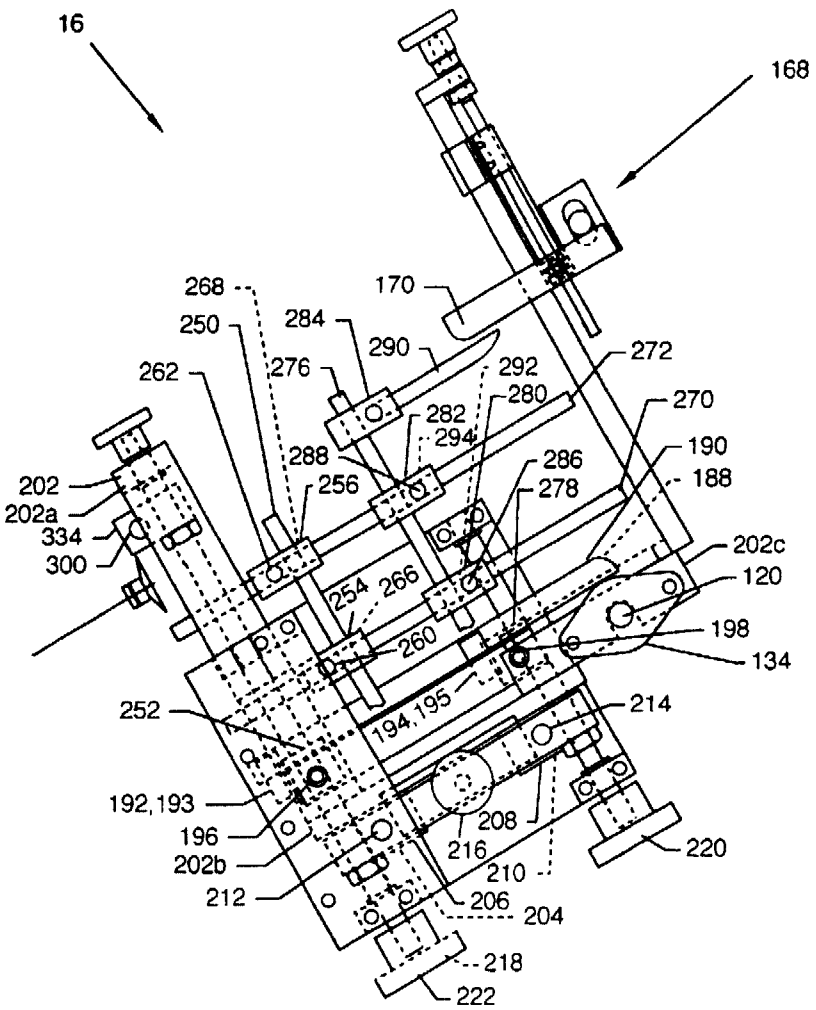
FIG. 8 illustrates a side view of the gravity hopper 16.

FIG. 7 illustrates an end view of the gravity hopper 16 along line 7—7 of FIG. 1, and FIG. 8 illustrates a side view of the gravity hopper 16 where all numerals correspond to those elements previously described. With reference to FIGS. 7 and 8, a plurality of adjustment mechanisms are located about the path of a paper cup sidewall member 80. The paper cup sidewall member 80 engages the toothed belt 160 of the inclined conveyor 14 described in FIGS. 4 and 9 and is delivered to and descendingly rides along, with gravitational assistance, lower opposing rails 188 and 190 which align in adjustable brackets 192 and 194 respectively. Adjustable brackets 192 and 193 secure to intermediate magazine shaft 196 and adjustable brackets 194 and 195 secure to intermediate magazine shaft 198. One end of each intermediate magazine shaft 196 and 198 secure to horizontal portion 200*b* of an L-bracket 200 also having a vertical portion 200*a* and another horizontal portion 200*c*. The other ends of each magazine shaft 196 and 198 secure to a horizontal portion 202*b* of an L-bracket 202 including a vertical portion 202*a* and another horizontal portion 202*c* (not illustrated). Horizontal portions 200*b* and 202*b* of brackets 200 and 202 secure to horizontal bearing assemblies 204, 206, 208 and 210 as illustrated. A lower magazine shaft 212 aligns through horizontal bearing block assemblies 204 and 206 and another parallel positioned lower magazine shaft 214 aligns through horizontal bearing block assemblies 208 and 210. An adjustment knob 216 turns a threaded shaft 211 extends through a threaded hole member in horizontally aligned bar 213 which is attached between the horizontal bearing block assemblies 206 and 208 to laterally adjust the L-brackets 200 and 202 and their attached component members along the lower magazine shafts 212 and 214. The smooth shank portion of the threaded shaft 211 aligns in a hole in a horizontally aligned but vertically positionable adjustment bar 228.

L-brackets 200 and 202 are also adjusted vertically with respect to the components of the gravity hopper 16 by actuation of vertical adjustment knobs 218 and 220 attached to a vertically oriented square plate 224 and by a vertical adjustment knob 222 attached to a vertically oriented rectangular plate 226. Vertical adjustment knob 218 rotates a vertically oriented threaded shaft 230 which rotatingly secures to bearing members 232 and 234 which are attached to the square plate 224. Correspondingly, vertical adjustment knob 220 rotates a vertically oriented threaded shaft 233 which rotatingly secures to bearing members 236 and 238 which are opposingly attached to the square plate 224. A horizontally aligned but vertically positionable adjustment bar 240, having internal threaded surfaces, aligns over and about the threaded shafts 230 and 233. One end of the lower magazine shafts 212 and 214 secure in the adjustment bar 240. In a similar fashion vertical adjustment knob 220 rotates a vertically oriented threaded shaft 242 which rotatingly secures to bearing members 244 and 246 which are attached to the rectangular plate 226. The horizontally aligned but vertically positionable adjustment bar 228, having internal threaded surfaces, aligns over and about the threaded shaft 242. The remaining ends of the lower magazine shafts 212 and 214 secure in the adjustment bar 228. Rotational movement of vertical adjustment knobs 218, 220 and 222 causes adjustment bars 228 and 240 to be vertically positioned correspondingly followed by vertical movement of the L-brackets 200 and 202 and the interceding components secured therebetween. This vertical positioning allows the gravity hopper 16 to be readily adjusted to meet and effectively interface with the paper cup sidewall member 80 carried by the belt member 160.

Components are also included between and in attachment to the L-brackets 200 and 202 which aid in alignment and stability of the ever moving paper cup sidewall member 80 or other such material as desired.

A guide assembly 248 is now described. A similarly constructed mirror image like opposing guide assembly 249 is not described for the purposes of clarity and brevity. A vertically oriented side bar mounting shaft 250 secures perpendicular to the magazine shaft 196 via a bracket 252. Mounting brackets 254 and 256 having a plurality of internal bores align over and about the mounting shaft 250. Horizontally oriented rods 260 and 262 are adjustably aligned through and secured to the mounting brackets 254 and 256 respectively. Side bar clamps 266 and 268 secure over the ends of the rods 260 and 262 respectively. One end of a horizontally aligned side bar guide 270 aligns and secures to the side bar clamp 266 and one end of another horizontally aligned side bar 272 aligns and secures to the side bar clamp 268. Another vertically oriented side bar mounting shaft 276 secures perpendicular to the magazine shaft 198 via a bracket 278. Mounting brackets 280, 282 and 284 having a plurality of internal bores align over and about the mounting shaft 276. Horizontally oriented rods 286, 288 and 290 are adjustably aligned through and secured to the mounting brackets 280, 282 and 284 respectively. Side bar clamps 292 and 294 secure over the ends of the rods 286 and 288 respectively. The remaining ends of the horizontally aligned side bar guide 270 aligns and secures to the side bar clamp 292 and one end of the other horizontally aligned side bar 272 aligns and secures to the side bar clamp 294. Rod 290 is in the form of a right angle and serves as an initial alignment device to guide the top edge of the paper cup sidewall member 80 during its transition on belt 160 from the inclined conveyor 14. Operation of lateral adjustment knob 216, as previously described, causes the L-brackets 200 and 202 to adjust laterally with respect to the paper cup sidewall member 80, as well as correspondingly positioning guide assemblies 248 and 249.

In addition to the guide assemblies 248 and 249 which offer guidance to the sides of the paper cup sidewall member 80, guidance along the top edge of the paper cup sidewall member 80 as the paper cup sidewall member 80 comes in close proximity to the rotary placement mechanism 18 is offered by guidance members mounted along a vertically positionable horizontally aligned top magazine shaft 300. Adjustable release clips 302 and 304 secure to positionable bracket members 306 and 308 which align over and about the top magazine shaft 300. Top bar guides 310 and 312 positionably secure and align over and about the top magazine shaft 300 by positionable brackets 314 and 316. In addition, lower release clips 318 and 320 adjustably secure to brackets 192 and 193. Vertical adjustability of the top magazine shaft 300 and its attached component members is provided by rotation of vertical adjustment knobs 322 and 324.

Operation of vertical adjustment knob 322 is now described with respect to vertical adjustment of the top magazine shaft. Operation of knob 324 and associated components is similar to that of knob 322 and is not described for purposes of brevity and clarity. Bearings 326 and 328 suitably secure to the vertical portion 202*a* of the L-bracket 202. A threaded shaft 330 having a lock nut 332 aligns through bearings 326 and 328 and is rotatably actuated by vertical adjustment knob 322. An adjustment block 334 threadingly engages the threaded shaft 330. One end of the top magazine shaft 300 aligns and secures to the adjustment block 334. Rotation of the vertical adjustment knob 332 in conjunction with the opposing knob 324 and similarly constructed members causes the top magazine shaft 300 to be positioned vertically.

FIG. 9 illustrates a cross sectional view of the belt 160 where all numerals correspond to those elements previously described. The belt 160 includes a central belt portion 163 having an annular tracking ridge 162 aligned along its bottom side and a plurality of lateral teeth 165*a*–165*n* aligned along the upper portion of the central belt 163. The lower edges of paper cup sidewall members 80 align between the teeth members 165*a*–165*n* for positive capture on the belt 160 for assured conveyance upwardly along the inclined conveyor 14 for presentation to the input side of the gravity hopper 16.

MODE OF OPERATION

Blanks, such as drinking cup sidewall members 80, are placed upon belts 70 and 72 of the lower horizontal input conveyor 12, such as illustrated in FIG. 3. Stack sense switch 84 detects an insufficient or sufficient quantity of obliquely aligned drinking cup sidewall members 80. If the quantity is insufficient, motor 24 is energized to provide a sufficient quantity of cup sidewall members 80 for transfer to the inclined conveyor 14. Transfer occurs at the junction of the lower horizontal input conveyor 12 and the inclined conveyor 14. The cup sidewall members 80 are transferred to the teeth 165*a*–165*n* of the belt 160 for transfer upwardly along the inclined conveyor 14 to the gravity hopper 16. The bottom center portion of the cup sidewall member 80 is supported at its lower concave-like edge between two of the teeth members 165*a*–165*n* for positive frictional engagement with the inclined hopper belt 16 and the paper cup sidewall member 80. Vertical guide panels 164 and 166 assist in guidance of the paper cup sidewall members 80 along the inclined conveyor 14. Stack sense switch 168 at the upper end of the inclined conveyor 14 senses sufficient or insufficient quantity of paper cup sidewall members 80 and activates motor 102 whereby belt 160 is activated to supply a sufficient quantity of paper cup sidewall members 80 to the upper region of the inclined conveyor 14 for gravitational distribution by the gravity hopper 16. FIG. 7 illustrates the junction of belt 160 of the inclined conveyor 14 with the members of the gravity hopper 16. Members of guide assembly 248, and corresponding members of guide assembly 249, such as lower product rail 190, side bar guide 270, side bar guide 272, horizontal rod 290, and top bar guide 312, provide for alignment of incoming paper cup sidewall members 80, as the sidewall members descend downwardly, as aided by gravity, through the gravity hopper 16 for interfacing with the rotary placement mechanism 18.

Alignment of the gravity hopper 10, with the guide members of the gravity hopper 16, is readily facilitated by vertical adjustment control knobs 218, 220 and 222, as well as adjustment horizontal knob 216. Vertical adjustment knobs 322 and 324 provide for adjustment of the top magazine shaft 300 and attached guide rods 310 and 312, and release clips 302 and 304 with respect to belt 160, lower product rails 188 and 190, and release clips 318 and 320.

Various modifications can be made to the present invention without departing from the apparent scope hereof.

I claim:

1. A conveyor system for delivering flat, irregularly shaped planar material in a vertical or oblique position comprising:

a. a horizontal conveyor positioned at approximately waist height;

b. an inclined conveyor that forms an intersection with said horizontal conveyor to receive conveyance of vertical planar material from said horizontal conveyor, said inclined conveyor comprising a toothed belt to engage the planar material and aid in conveyance of the planar material and said inclined conveyor further comprising adjustable guide assemblies to assist in guidance of the planar material along said inclined conveyor;

c. a lower stack sensing switch and activated lever located at said intersection that activates a belt on said horizontal conveyor if the obliquely positioned planar material is of insufficient supply to said inclined conveyor;

d. an inclined gravity hopper that is mounted to a conveyor shaft positioned at the top of said inclined conveyor to receive the obliquely positioned planar material from said inclined conveyor; and, e. said gravity hopper comprising a top magazine shaft and top bar guides that are vertically adjustable for guiding the planar material from said inclined hopper into said gravity hopper.

2. A conveyor system for delivering flat, irregularly shaped planar material in a vertical or oblique position comprising:

a. a horizontal conveyor positioned at approximately waist height;

b. an inclined conveyor that forms an intersection with said horizontal conveyor to receive conveyance of vertical planar material from said horizontal conveyor, said inclined conveyor comprising a toothed belt to engage the planar material and aid in conveyance of the planar material and said inclined conveyor further comprising adjustable guide assemblies to assist in guidance of the planar material along said inclined conveyor;

c. an inclined gravity hopper that is mounted to a conveyor shaft positioned at the top of said inclined conveyor to receive the obliquely positioned planar material from said inclined conveyor;

d. an upper stack sensing switch located at the top of said inclined conveyor that activates a belt on said inclined conveyor if the obliquely positioned planar material is of insufficient supply to said inclined hopper; and e. said gravity hopper comprising a top magazine shaft and top bar guides that are vertically adjustable for guiding the planar material from said inclined hopper into said gravity hopper.

3. A conveyor system for delivering flat, irregularly shaped planar material in a vertical or oblique position comprising:

a. a horizontal conveyor positioned at approximately waist height;

b. an inclined conveyor that forms an intersection with said horizontal conveyor to receive conveyance of vertical planar material from said horizontal conveyor;

c. a lower stack sensing switch and activated lever located at said intersection that activates a belt on said horizontal conveyor if the obliquely positioned planar material is of insufficient supply to the inclined conveyor;

d. an inclined gravity hopper that is mounted to a conveyor shaft positioned at the top of said inclined conveyor to receive the planar material from said inclined conveyor;

e. an upper stack sensing switch located at the top of said inclined conveyor that activates a belt on said inclined conveyor if the obliquely positioned planar material is of insufficient supply to said inclined hopper; and, f. said gravity hopper comprising a top magazine shaft and top bar guides that are vertically adjustable for guiding the planar material from said inclined hopper into said gravity hopper.

4. The system of claim 1, 2 or 3 further comprising a rotary placement means which interfaces with said inclined gravity hopper and receives the planar material from said inclined gravity hopper.

5. The system of claim 1, 2 or 3, wherein the planar material being delivered by said conveyor system comprises paper cup sidewall members.

6. The system of claim 1, 2 or 3, further comprising vertical channel guides flanking said inclined conveyor to guide the planar material.

7. The system of claim 3, wherein a belt found on said inclined conveyor contains teeth to engage the planar material to aid in conveyance of the planar material.

8. The process of conveying flat planar material in a vertical or oblique position comprising:

a. placing the planar material in a vertical or oblique position onto a lower horizontal conveyor;

b. activating a lower stack sensing switch due to the insufficiency of planar material on said horizontal conveyor thereby conveying the planar material to an inclined conveyor;

c. obliquely conveying the planar material upwards along said inclined conveyor using a single belt;

d. activating an upper stack sensing switch due to the insufficiency of the planar material delivered to an inclined gravity hopper; and, e. delivering the planar material for storage in said inclined gravity hopper.

9. The process of claim 8, wherein the planar material is further transferred from said inclined gravity hopper to a rotary placement means.

* * * * *